US005429468A

United States Patent [19]

Kojima

[11] Patent Number: 5,429,468

[45] Date of Patent: Jul. 4, 1995

[54] COVER ALIGNMENT APPARATUS FOR BOOK BINDER

[75] Inventor: Nobuyuki Kojima, Kyoto, Japan

[73] Assignee: Horizon International Inc., Shiga, Japan

[21] Appl. No.: 67,691

[22] Filed: May 26, 1993

[30] Foreign Application Priority Data

May 27, 1992 [JP] Japan ..... 4-180269

[51] Int. Cl.[6] ..... B42C 11/02

[52] U.S. Cl. ..... 412/19

[58] Field of Search ..... 412/1, 4, 5, 18, 19, 412/21, 24

[56] References Cited

U.S. PATENT DOCUMENTS 4,491,448 1/1985 Anders et al. ..... 412/21

FOREIGN PATENT DOCUMENTS 3827283 3/1989 Germany ..... B42C 19/08
2082506 3/1982 United Kingdom ..... B42C 11/04
2236074 3/1991 United Kingdom ..... B42C 11/04

OTHER PUBLICATIONS

European Patent Office Communication, Application No. 93250147.1, Date Oct. 4, 1993, p. 1.
European Search Report, Application No. EP 93 25 0147, Date of completion of the search Sep. 15, 1993, p. 1.
Annex to the European Search Report on European Patent Application No. EP 93 25 0147, Sep. 15, 1993, p. 1.
Abstract, 93250147.1, p. 1.
"The Golf 370 Perfect Binder—An Investment for the Future" published by A M Wohlenberg GmbH in the Federal Republic of Germany in 1990, 8 pages.

*Primary Examiner*—Willmon Fridie
*Attorney, Agent, or Firm*—Morgan & Finnegan

[57] ABSTRACT

According to the invention, an apparatus is provided for aligning a cover to the spine of a book block in a book binder, the binder including clamp means for clamping the block. The clamp means is movable along a track to transport the block in a substantially horizontal direction to a station in which a cover is aligned and glued to the spine of the block. The apparatus comprises a table disposed in the station for supporting the cover thereon, the clamp means being movable over the table. The apparatus further comprising a cover feeder for feeding the cover onto the table. The clamp means includes cover engagement means provided at the trailing end thereof and adapted to be engaged with the trailing edge of the cover on the table when the clamp means is moved over the table in the station. The cover is aligned intermediate its length to the spine of the block and transported by the engagement means with the movement of the clamp means.

4 Claims, 3 Drawing Sheets

COVER ALIGNMENT APPARATUS FOR BOOK BINDER

FIELD OF THE INVENTION

The invention relates to an apparatus for aligning a cover to the spine of a book block in a book binder.

PRIOR ART

In making books, there has been generally used a book binder including a plurality of clamps for each clamping a book block. The clamps are spaced to each other and movable along a track to successively transport the blocks in a substantially horizontal direction to a station. The binder further includes cover feeder means for feeding and transporting a cover in the same direction and at the same speed as the block to the station so that the cover is aligned and glued to the spine of the block in the station. The cover feeder is independent of the clamp. However, the binder has a problem that it is difficult to conveniently feed and transport the cover in unison with the block by the cover feeder. Accordingly, the cover is not always precisely aligned to the spine of the block.

SUMMARY OF THE INVENTION

It is therefore an object of the invention to provide a new and improved apparatus for aligning a cover to the spine of a book block in a book binder, which overcomes the problem described above.

The other object of the invention is to reliably align the cover to the spine of a book block.

According to the invention, an apparatus is provided for aligning a cover to the spine of a book block in a book binder, the binder including clamp means for clamping the block. The clamp means is movable along a track to transport the block in a substantially horizontal direction to a station in which a cover is aligned and glued to the spine of the block.

The apparatus comprises a table disposed in the station for supporting the cover thereon, the clamp means being movable over the table. The apparatus further comprises a cover feeder for feeding the cover onto the table. The clamp means includes cover engagement means provided at the trailing end thereof and adapted to be engaged with the trailing edge of the cover on the table when the clamp means is moved over the table in the station. The cover is aligned intermediate its length to the spine of the block and transported by the engagement means with the movement of the clamp means.

In a preferred embodiment, the cover feeder is disposed upstream of the table to feed the cover in the direction in which the block is transported. The cover is fed onto the table immediately before the clamp means reaches the station.

The clamp means includes an elongated member extending substantially horizontally and perpendicularly to the direction in which the block is transported. The engagement means comprises a pair of protrusions formed at the opposite ends of the elongated member and extending radially of the elongated member. The protrusions are movable along the opposite sides of the table to be engaged with the trailing edge of the cover.

The elongated member is fixed to a shaft, which extends parallel to the elongated member. The shaft is mounted on the clamp means for rotational movement between a first position in which the protrusions extend downwardly and forwardly from the opposite ends of the elongated member to be engaged with the trailing edge of the cover and a second position in which the protrusions extend rearwardly from the opposite ends of the elongated member. The shaft is resiliently urged toward the second position by a spring and provided with an arm extending radially of the shaft. The arm includes a roller which is mounted on the end of the arm for rotation and adapted to be engaged with a dog disposed in the station to rotate the shaft to the first position immediately before the clamp means reaches the station. The don has a length and extends in the direction in which the block is transported so that the shaft is held in the first position during the clamp means is moved above the table in the station.

The apparatus further comprises means for lifting or lowering the dog to adjust the first position of the shaft so that the cover is conveniently aligned to the spine of the block.

The elongated member is mounted on the shaft for rotational movement thereabout and fixed to the shaft by screw means. The screw means can be manipulated to adjust the angular position of the elongated member with respect to the shaft so that the cover is precisely aligned to the spine of the block.

The apparatus embodying the invention is hereinafter described, by way of example, with reference to the accompanying drawings.

DETAILED DESCRIPTION OF THE PREFERRED EMBODIMENT

Figure 1:
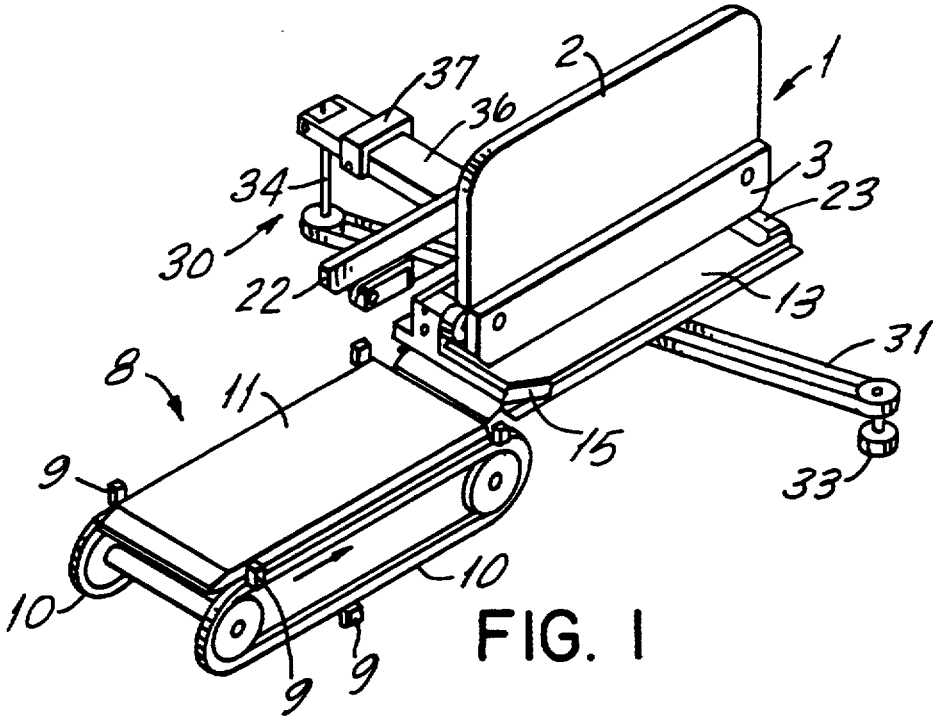
FIG. 1 perspective view of an apparatus for aligning a cover to the spine of a book block in a book binder according to the invention.
Figure 2:
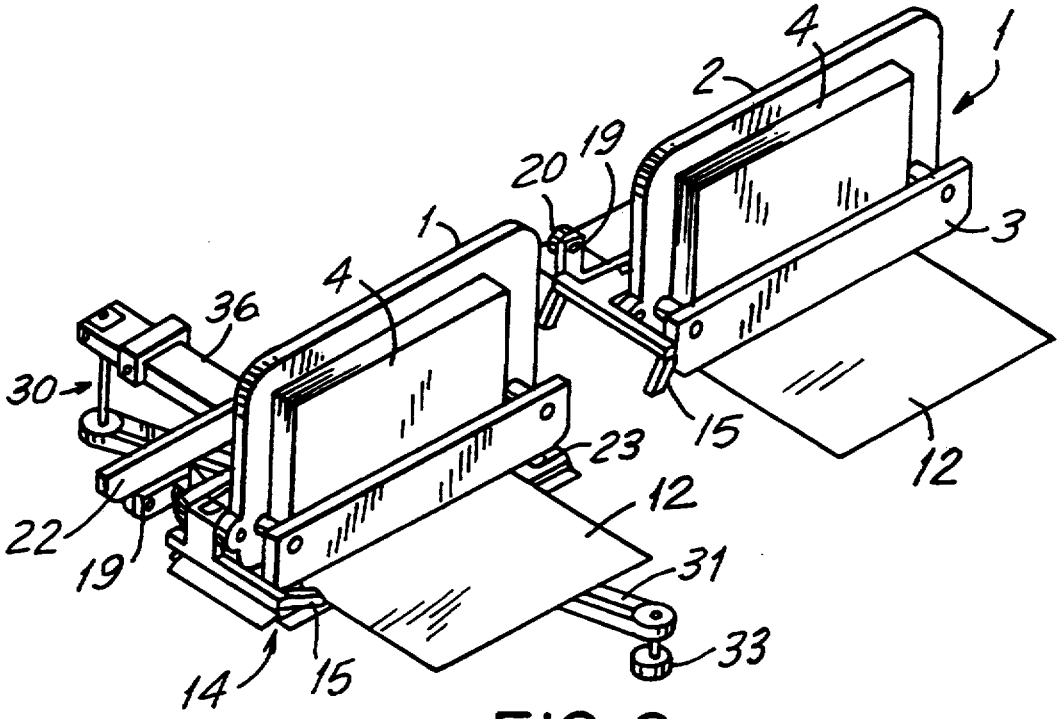
FIG. 2 is a perspective view showing the apparatus in FIG. 1 in which book blocks and covers are transported.
Figure 3:
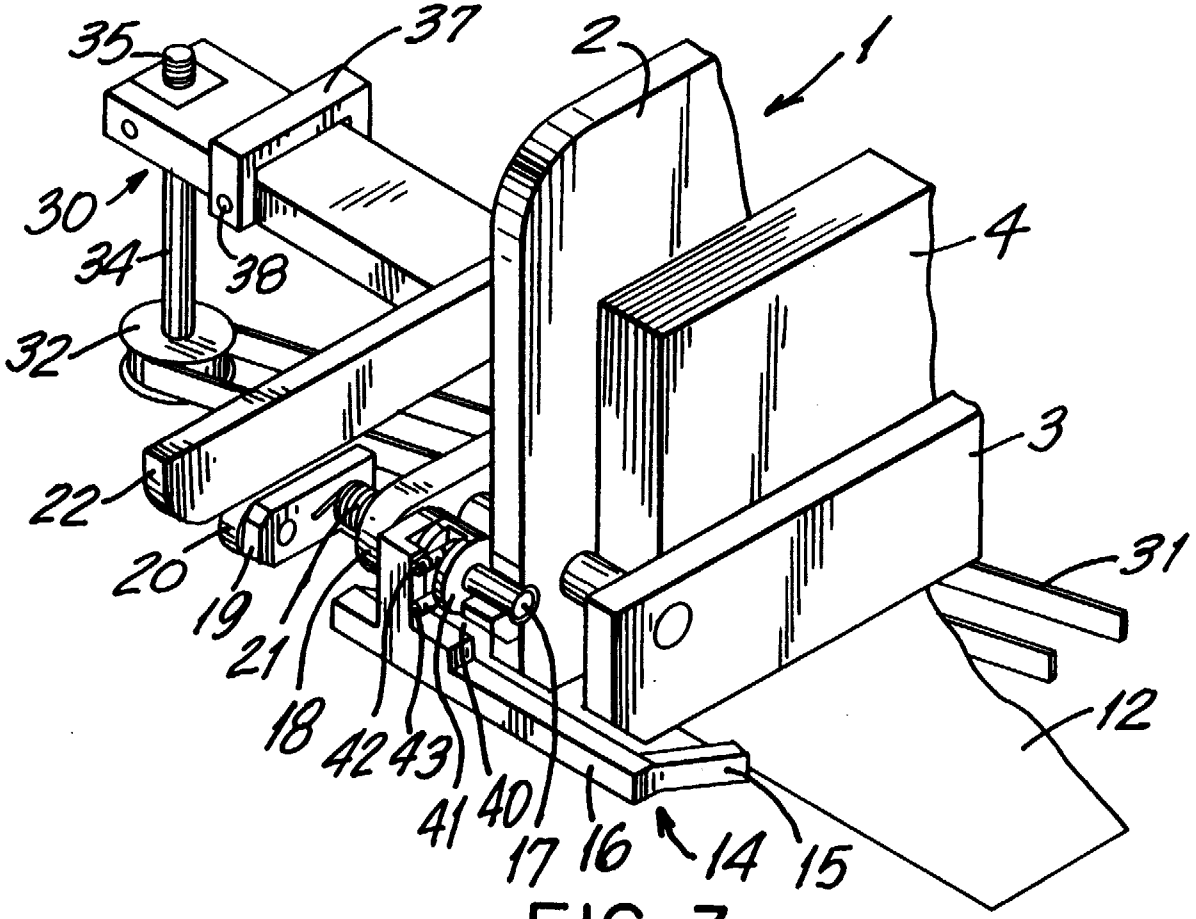
FIG. 3 is a perspective view, on an enlarged scale, showing the apparatus in FIG. 2.
Figure 4:
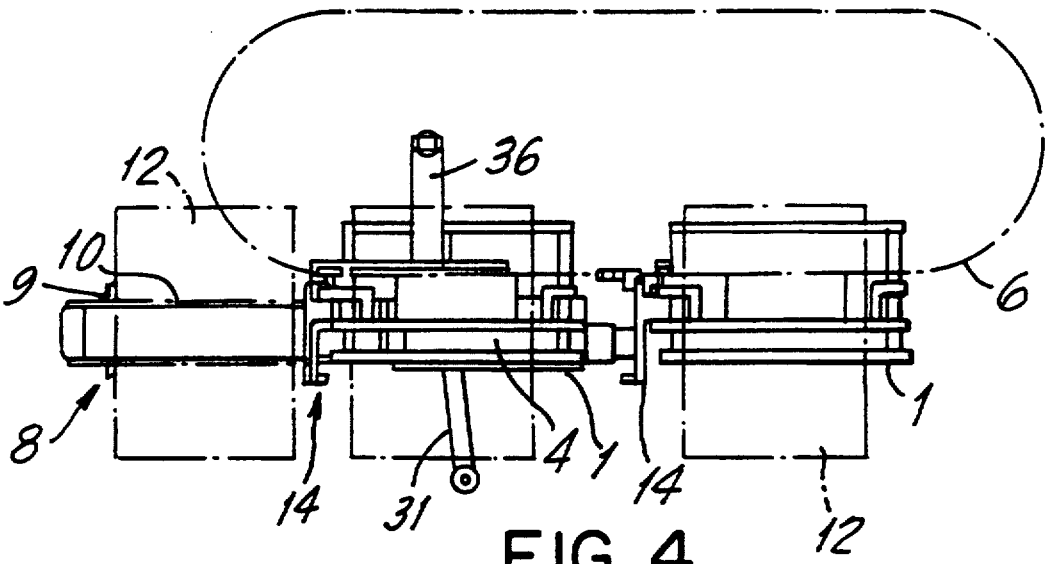
FIG. 4 is a plain view of the apparatus in FIG. 2.
Figure 5:
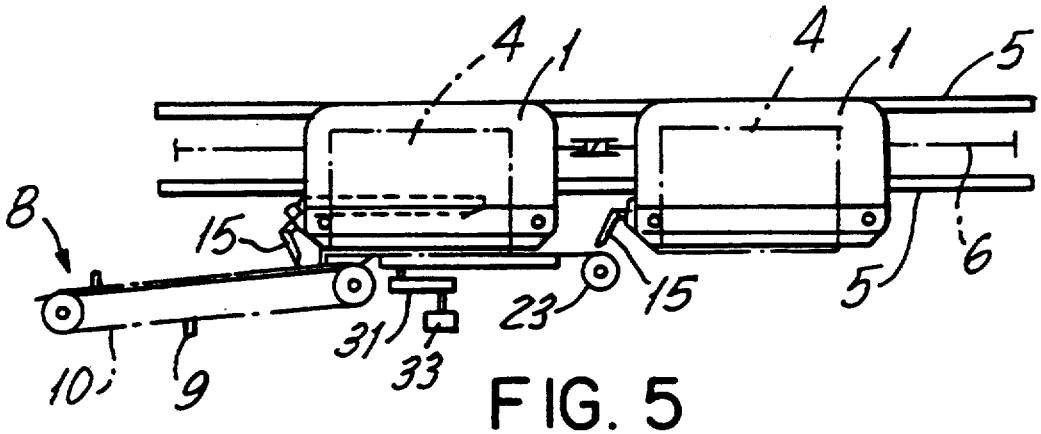
FIG. 5 is a elevational view of the apparatus in FIG. 4.
Figure 6:
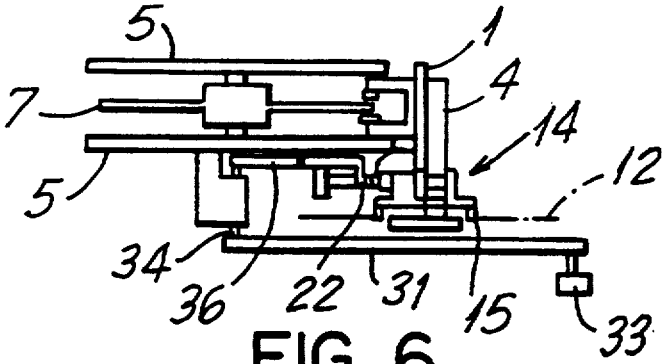
FIG. 6 is a side view of the apparatus in FIG.

Referring to FIG. 1, there is illustrated an apparatus for aligning a cover to the spine of a book block in a book binder according to the invention. The binder includes clamp means comprising a plurality of clamps 1 each of which comprises a fixed plate 2 and a movable plate 3. The plate 3 can be moved toward the plate 2 to clamp a book block 4 therebetween as shown in FIGS. 2 and 3. The binder further includes a track for the clamps 1, which comprises upper and lower rails 5 extending substantially horizontally as shown in FIGS. 4 and 5, the clamps 1 each including an insert formed integrally with the plate 2 thereof and received between and engaged with the rails 5 as shown in FIG. 6. An endless chain 6 extends between the rails 5, the chain 6 being engaged with and driven by the sprockets 7 which are disposed between the rails 5 and rotated by a drive means not shown. The clamps 1 are spaced to each other along the rails 5 and connected to the chain 6 so that the clamps 1 are moved along the rails 5 by the chain 6 to successively transport the blocks 4 in a substantially horizontal direction to a station, in which a cover 12 is aligned and glued to the spine of the block 4, as described below.

The apparatus includes a table 13 extending substantially horizontally and disposed in the station for supporting the cover 12 thereon, the clamp 1 being movable over the table 13. The apparatus further includes a cover feeder 8 disposed upstream of the table 13. The cover feeder 8 comprises a plurality of pins 9 spaced to each other along a pair of endless chains 10 and mounted thereon, the chains 10 being engaged with sprockets which are rotated by a drive means not shown. A table 11 is disposed between the upper runs of the chains 10, the cover 12 being supplied onto the table 11 by a supply means not shown and supported on the table 11. The pins 9 are then moved by the chain 10 and engaged with the trailing edge of the cover 12 to feed the cover 12 in the direction in which the block 4 is transported. The cover 12 is fed onto the table 13 immediately before the clamp 1 reaches the station.

The clamps 1 each includes cover engagement means 14 provided at the trailing end thereof. In the embodiment, the clamps 1 each includes an elongated member 16 extending substantially horizontally and perpendicularly to the direction in which the block 4 is transported. The engagement means 14 comprises a pair of protrusions 15 formed at the opposite ends of the elongated member 16 and extending radially of the elongated member 16. The protrusions 15 are positioned to be movable along the opposite sides of the table 13 when the clamp 1 is moved over the table 15 in the station.

The elongated member 16 is fixed to a shaft 17 which extends parallel to the elongated member 16. The shaft 17 is supported by the plate 2 of the clamp 1 and an arm 18 which is fixed to the plate 2 so that the shaft 17 is mounted on the clamp 1 for rotational movement between a first position in which the protrusions 15 extend downwardly and forwardly from the opposite ends of the elongated member 16 to be engaged with the trailing edge of the cover 12 and a second position in which the protrusions 15 extend rearwardly from the opposite ends of the elongated member 16, as shown in FIG. 2. The shaft 17 is resiliently urged toward the second position by a spring 21 and provided with an arm 19 extending radially of the shaft 17, the spring 21 extending spirally about the shaft 17 between the arms 18 and 19. The arm 19 includes a roller 20 which is mounted on the end of arm 19 for rotation and adapted to be engaged with a dog 22 disposed in the station. The dog 22 has a length and extends in the direction in which the block 4 is transported.

When the clamp 1 is moved over the table 11, the shaft 17 is held in the second position with the protrusions 15 extending rearwardly from the opposite ends of the elongated member 16 so that the cover 12 can be supplied onto the table 11 in the direction in which the clamp 1 is moved. The cover 12 is fed by the pins 9 of the chains 10 onto the table 13 at the substantially same speed as the clamp 1. The roller 20 is then engaged with the dog 22 to rotate the shaft 17 to the first position immediately before the clamp 1 reaches the station so that the protrusions 15 extend downwardly and forwardly from the opposite ends of the elongated member. Accordingly, the protrusions 15 are engaged with the trailing edge of the cover 12 on the table 13 when the clamp 1 is moved over the table 13 in the station. The shaft 17 is held in the first position during the clamp 1 is moved above the table 13 in the station so that the cover 12 is reliably aligned intermediate its length to the spine of the block 4 and transported by the protrusions 15 with the movement of the clamp 1.

The block 4 and the cover 12 are transported in alignment relationship by the clamp 1 and the protrusions 15 to a roller 23 which is mounted on the end of the table 13 for rotation. The cover 12 is rode on the roller 23 and pressed against the spine of the block 4. The spine has a glue applied thereon so that the cover 12 is glued to the spine of the block 4. The roller 20 is then disengaged from the dog 22 so that the shaft 17 is rotated to and held in the second position by the spring 21 so that the clamp 1 is moved with the protrusions 15 extending rearwardly from the opposite ends of the shaft 17.

The apparatus further includes means 30 for lifting and lowering the dog 22. The means 30 comprises a endless belt 31 engaged with a pair of pulleys 32, one of which is provided with a handle 33, the other being fixed to a shaft 34 supported by bearing means not shown for rotation. The shaft 34 has a threaded portion 35 threadedly engaged with the end of a arm 36 which is supported on pins 38 of a rim 37 for pivotal movement. The rim 37 is fixedly mounted on a frame not shown. The dog 22 is fixedly mounted on and supported by the other end of the arm 36. When it is required to change the size of the cover 12 with respect to the block 4, the handle 33 is manipulated to rotate the shaft 34 so that the arm 36 is pivotally moved about the pins 38 by the threaded portion 35 of the shaft 32 to lift or lower the dog 22. Accordingly, the first position of the shaft 17 can be optionally adjusted to change the direction of the protrusions 15 so that the cover 12 is conveniently aligned when changing the size of the cover 12.

In addition, the apparatus includes means 40 for fixing the elongated member 16 to the shaft 17. The elongated member 16 has an extention formed integrally therewith and mounted on the shaft 17 for rotational movement about the shaft 17. The means comprises a channel portion 41 formed in the shaft 17 and a pair of screws 22 and 43. The screws 42 and 43 are threadedly engaged with the extention of the elongated member 16 and pushed against the inner surface of the channel portion 41 on the opposite sides of the shaft 17 so that the elongated member 16 is fixed by the screws 42 and 43. Accordingly, the screws 42 and 43 can be manipulated by loosening one of them and fastening the other to adjust the angular position of the elongated member 16 with respect to the shaft 17 so that the cover 12 is precisely aligned to the spine of the block.

What is claimed is:

1. An apparatus for aligning a cover to the spine of a book block in a book binder, said binder including clamp means for clamping the block, said clamp means being movable along a track to transport the block in a substantially horizontal direction to a station in which a cover is aligned and glued to the spine of the block, said apparatus comprising:

a table disposed in said station for supporting the cover thereon, said clamp means being movable over said table;

a cover feeder disposed upstream of said table to feed the cover onto said table in the direction in which the block is transported, the cover being fed onto said table immediately before said clamp reaches said station, and cover engagement means provided at the trailing end of said clamp means, said clamp means including an elongated member extending substantially horizontally and perpendicularly to the direction in which said block is transported, said cover engagement means comprising a pair of protrusions formed at the opposite ends of said elongated member and extending radially of said elongated member, said protrusions being movable along the opposite sides of said table to be engaged with the trailing edge of said cover on said table when said clamp means is moved over said table in said station whereby said cover is aligned intermediate its length to the spine of the block and transported by said engagement means with the movement of said clamp means.

2. An apparatus as set forth in claim 1, wherein said elongated member is fixed to a shaft which extends parallel to said elongated member, said shaft being mounted on said clamp means for rotational movement between a first position in which said protrusions extend downwardly and forwardly from the opposite ends of said elongated member to be engaged with the trailing edge of said cover and a second position in which said protrusions extend rearwardly from the opposite ends of said elongated member, said shaft being resiliently urged toward said second position by a spring and provided with an arm extending radially of said shaft, said arm including a roller which is mounted on the end of said arm for rotation and adapted to be engaged with a dog disposed in said station to rotate said shaft to said first position immediately before said clamp means reaches said station, said dog having a length and extending in the direction in which said block is transported so that said shaft is held in said first position during said clamp means is moved above said table in said station.

3. An apparatus as set forth in claim 2, further comprising means for lifting or lowering said dog to adjust said first position of said shaft so that the cover is conveniently aligned to the spine of the block.

4. An apparatus as set forth in claim 3, said elongated member is mounted on said shaft for rotational movement thereabout and fixed to said shaft by screw means, said screw means being manipulated to adjust the angular position of said elongated member with respect to said shaft so that the cover is precisely aligned to the spine of the block.

* * * * *